US005576924A

United States Patent [19]

Hee

[11] Patent Number: 5,576,924

[45] Date of Patent: Nov. 19, 1996

[54] HEEL GROUNDING DEVICE

[76] Inventor: Roland Hee, 201 Bougainvilla Street, Ayala Alabang Village, Muntinlupa, Philippines, 1780

[21] Appl. No.: 509,712

[22] Filed: Jul. 31, 1995

[51] Int. Cl.[6] ..... H05F 3/02

[52] U.S. Cl. ..... 361/223

[58] Field of Search ..... 361/223, 224, 361/212, 220; 174/556

[56] References Cited

U.S. PATENT DOCUMENTS

| | | | |
|---|---|---|---|
| 1,531,862 | 3/1925 | Larned . | |
| 2,586,747 | 2/1952 | Van Atta | 175/264 |
| 2,928,100 | 3/1960 | Gagnon | 2/339 |
| 2,955,234 | 10/1960 | Price . | |
| 2,998,697 | 9/1961 | Augenstein | 59/80 |
| 3,063,447 | 11/1962 | Kirsten | 128/134 |
| 3,377,509 | 4/1968 | Legge . | |
| 3,422,460 | 1/1969 | Burke et al. | 2/73 |
| 3,424,693 | 1/1969 | Lupinski | 252/500 |
| 3,459,997 | 8/1969 | Legge . | |
| 3,541,389 | 11/1970 | Van Name . | |
| 3,582,448 | 6/1971 | Okuhashi et al. | 161/87 |
| 3,596,134 | 7/1971 | Burke . | |
| 3,699,590 | 10/1972 | Webber et al. | 2/73 |
| 3,810,258 | 5/1974 | Mathauser | 339/12 R |
| 3,812,861 | 5/1974 | Peters | 128/418 |
| 3,832,841 | 9/1974 | Cole | 57/152 |
| 3,851,456 | 12/1974 | Hamada et al. | 57/140 BY |
| 3,857,397 | 12/1974 | Brosseau | 128/384 |
| 3,904,929 | 9/1975 | Kanaya et al. . | |
| 3,949,129 | 4/1976 | Hubbard | 428/190 |
| 3,986,530 | 10/1976 | Maekawa | 139/425 R |
| 3,987,613 | 10/1976 | Woods et al. | 57/140 BY |
| 4,025,964 | 5/1977 | Owens | 3/1 |
| 4,112,941 | 9/1978 | Larimore | 128/2.06 E |
| 4,211,456 | 7/1980 | Sears | 339/12 R |
| 4,267,233 | 5/1981 | Tanaka et al. | 428/389 |
| 4,321,789 | 3/1982 | Dammann et al. | 57/224 |
| 4,373,175 | 2/1983 | Mykkanen | 361/220 |
| 4,398,277 | 8/1983 | Christiansen | 361/220 |
| 4,402,560 | 9/1983 | Swainbank | 339/11 |
| 4,420,529 | 12/1983 | Westhead | 428/244 |
| 4,422,483 | 12/1983 | Zins | 139/420 R |
| 4,453,294 | 6/1984 | Morita | 24/303 |
| 4,459,633 | 7/1984 | Vandermark | 361/220 |
| 4,475,141 | 10/1984 | antonevich | 361/220 |

(List continued on next page.)

FOREIGN PATENT DOCUMENTS

| | | | |
|---|---|---|---|
| 2547390 | 5/1977 | Germany . | |
| 3622948 | 1/1988 | Germany | 439/39 |
| 791199 | 2/1958 | United Kingdom | 361/223 |
| 1067260 | 5/1967 | United Kingdom . | |

OTHER PUBLICATIONS

"Magnetic Ground Strap Connector", Technical Digest, No. 76, Mar. 1985, p. 21.

ESD Control Products, "Trustat" Footwear and Grouding Accessories, SIMCO, p. 39 and TRUSTAT Conductive Wrist Straps and Ground Leads, p. 40, no date.

Westek Electrostatics, "Leg and Shoe Grounders", p. 8 and Personnel Grouding, p. 7, no date.

*Primary Examiner*—Fritz M. Fleming

*Attorney, Agent, or Firm*—Stetina Brunda & Buyan

[57] ABSTRACT

An improved heel grounding device includes a pair of buckles, each having a hook member or clip that attaches to the upper portion of the wearer's shoe. The device further includes a conductive strip extending from the first buckle around the shoe heel through the second buckle, and then into electrical contact with the wearer. The second buckle preferably has a locking flap, such that the length of conductive strap between the buckles may be adjusted and locked into place, prior to tucking the end of the strap inside the wearer's sock. The grounding device of the present invention is readily adaptable to a wide range of shoe styles and sizes, offering improved fitting and wearing over existing heel grounders. Additionally, the conductive strap portion is disposable and easily replaced, thereby reducing the costs associated with effective control of electrostatic discharge.

5 Claims, 1 Drawing Sheet

U.S. PATENT DOCUMENTS

| | | | |
|---|---|---|---|
| 4,551,783 | 11/1985 | Cohen et al. | 361/223 |
| 4,577,256 | 3/1986 | Breidegam | 361/220 |
| 4,639,825 | 1/1987 | Breidegam | 361/212 |
| 4,676,561 | 6/1987 | Barrett, II | 439/37 |
| 4,677,521 | 6/1987 | Frazier | 361/220 |
| 4,847,729 | 7/1989 | Hee | 361/220 |
| 4,878,148 | 10/1989 | Hee | 361/220 |
| 5,004,425 | 4/1991 | Hee | 439/37 |
| 5,184,275 | 2/1993 | Wiegel et al. | 361/223 |
| 5,191,505 | 3/1993 | Gordon et al. | 361/223 |

HEEL GROUNDING DEVICE

FIELD OF THE INVENTION

The present invention relates generally to devices for dissipating electrostatic voltages from the wearer to earth ground, and more particularly to such devices worn around the heel portion of the wearer's shoe to be in electrical contact with conductive flooring.

BACKGROUND OF THE INVENTION

In the assembly of electronic components, a major threat to the quality of such assemblies is the electrical potential difference existing between the electrical part assembly and the operator which may cause the part to be damaged. The fundamental solution to this electrostatic discharge problem in the work place is to provide a means to directly ground the operator to zero electrical potential. Wrist strap devices are the most common prior art means to ground operators at their work stations, but these devices suffer from the disadvantage of limiting operator movement between work stations.

As such, various foot wear has been developed in the prior art having the capability of conducting electrical charges to ground while still offering operators, supervisory personnel, individuals on tours, etc., mobility throughout the work place. The typical prior art heel grounders for comprise a unitary conductive rubber "cup" that fits over the heel of a shoe, and a conductive fabric strap which extends therefrom to be in electrical contact with the wearer's leg. Such heel grounder typically is held on the wearer's foot by an elastic strap or a hook-and-loop (Velcro™) fastening arrangement. Such devices are relatively durable, usually lasting several months, but are also costly. Additionally, such devices often do not accommodate differing size and configurations of worker's shoes which vary greatly, especially between men and women.

Because the heel grounder is in intimate contact with the wearer, heel grounders are generally not passed from one person to another. The heel grounder for a visitor or a temporary employee is usually discarded, regardless of its condition. Disposable short-term use devices have been developed for transient visitors or personnel, typically consisting of a conductive strip which adheres to the heel of the shoe and is tucked into the shoe or sock to make contact with the wearer. These devices tend to become easily damaged, however, and thus their utility is limited.

Recognizing that the conductive rubber "cup" portion of conventional heel grounder devices may become soiled from the conductive flooring over which the operator moves about, it has been proposed to add flush head metal rivets or other enhancements to insure electrical contact with the floor. Such devices may cause discomfort, however, as the operator walks over hard flooring, and additionally add to the cost of manufacture of the device.

Although the available prior art heel grounders have proven generally suitable for their intended purposes, based on the inherent deficiencies discussed above, it is desirable to provide a heel grounder offering improved fitting and wearing to the user, and further having replaceable components to meet the needs of a single user over time or the needs of multiple users.

SUMMARY OF THE INVENTION

The present invention specifically addresses and alleviates the above-mentioned deficiencies associated with the prior art. More particularly, the present invention comprises an electrical grounding device adaptable to worn around the heel portion of the wearer's shoe and further extending to be attached to the wearer's leg. The device includes a pair of buckles, each having a hook member or cup that rapidly attaches to the upper portion of the wearer's shoe. The device further includes a conductive strip extending from the first buckle around the shoe heel through the second buckle, and then into electrical contact with the wearer. The device provides effective discharge of electrostatic voltages from the wearer to ground.

In a preferred embodiment of the invention, the second buckle of the grounding device has adjustment means, preferably a locking flap, such that the length of conductive strap from the first buckle may be adjusted and then locked into place. The conductive strap is preferably an elastic material providing stretchability. Additionally, the conductive strap provides a resistance preferably in the range from 106 to 108 ohms.

The grounding device provides improved fitting and wearing over existing heel grounders, in that it is readily adaptable to a wide range of shoe styles and sizes. The conductive strap portion is additionally disposable and easily replaced, thereby reducing the costs associated with effective control of electrostatic discharge.

These, as well as other advantages of the present invention will become more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be within the spirit and scope of the invention.

Figure 1:
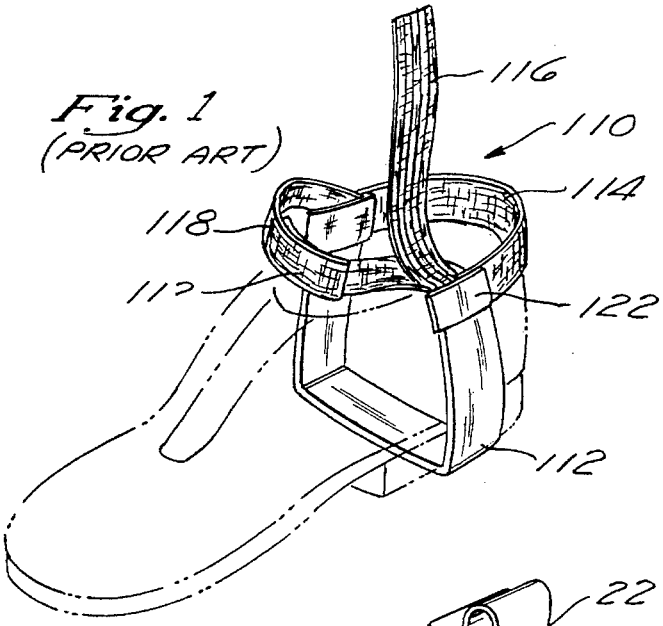
Fig. 1 (PRIOR ART)
FIG. 1 is a perspective view of a prior art heel grounder as installed on a wearer's shoe.

First, referring to FIG. 1, a typical prior art heel grounder 110 is depicted. The prior art heel grounder 110 generally includes a conductive carbonized rubber cup having a heel band 112 and a counter band or garter band 114. The prior art device 110 additionally includes a fabric grounding tab 116 generally of a woven polyester material coated with a conductive elastomer (such as neoprene loaded with 30% carbon), or alternatively metallic thread (such as silver yarn) is interwoven into the fabric of the grounding tab 116. The prior art device also includes a plastic fastening strap 118 typically having a hook and loop fastener 120. The conductive rubber band 112, garter band 114, and fastening strap 118 are permanently tied together at the junction points with a strong adhesive or by sewing. The prior art device 110 may also include a 1 meg ohm chip resistor 122 for additional safety of the wearer against electric shock, the resistor 122 installed at the connection between the grounding tab 116 and the conductive rubber heel band 112.

In use, the prior art device 110 is pulled over the heel portion of the wearer's shoe, the fastening strap 118 is tightened and the Velcro fastener 120 engaged, and the grounding tab 116 is tucked inside the wearer's sock. The wearer is preferably standing or walking on conductive vinyl flooring or a conductive vinyl mat, which is electrically grounded to a zero potential. Due to the variety of sizes and styles of shoes however, often the conductive rubber heel band 112 and garter band 114 do not fit the shoe snugly, even after the fastening strap 118 is tightened. As can also be appreciated the heel band 112 tends to become quickly soiled and wear thin, shortening the effective life of the prior art device 110.

Figure 2:
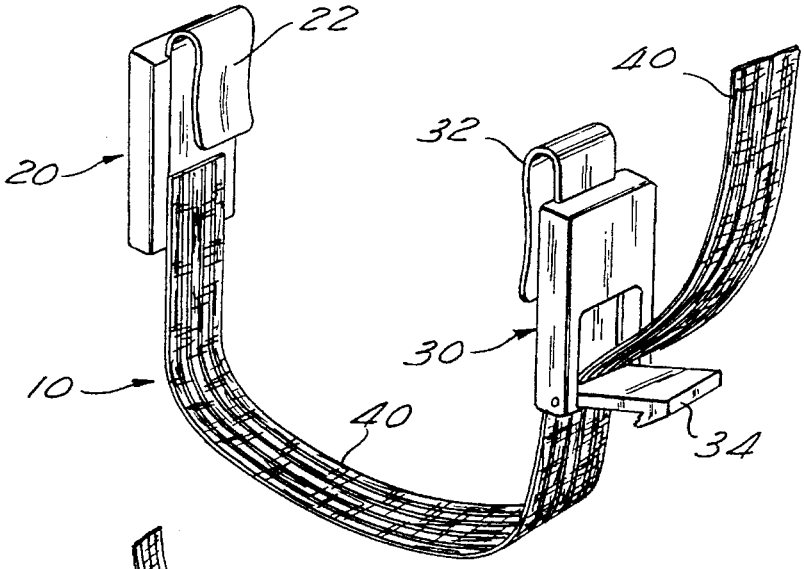
FIG. 2 is an enlarged perspective view of the components of the heel grounder of the present invention.
Figure 3:
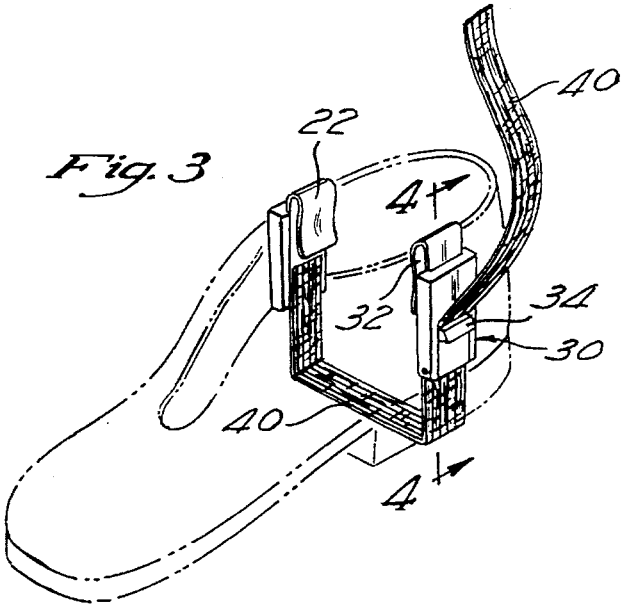
FIG. 3 is a perspective view of the heel grounder of the present invention as installed on the wearer's shoe.
Figure 4:
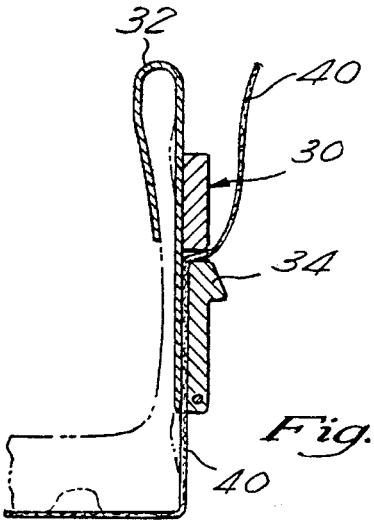
FIG. 4 is a partial front section view of the heel grounder of the present invention as installed on the wearer's shoe.

Now referring to FIGS. 2–4, the improved heel grounding device 10 of the preferred embodiment of the present invention may now be described. The heel grounder 10 includes a first buckle 20 and a second buckle 30, and a conductive strap 40 extending from the first buckle 20 through the second buckle 30 and into electrical contact with the wearer's leg. The buckles 20 and 30 include an electrically conductive hook member or clip 22 and 32 respectively, or other means, to attach the buckles 20 and 30 to the upper portion of the wearer's shoe as shown in FIGS. 3 and 4. The buckles are preferably fabricated of an insulating plastic material. The end of the conductive strap 40 extends past the second buckle 30 for tucking inside the wearer's sock as is conventional in the use of heel grounders.

The second buckle 30 preferably includes adjustment means, such as a locking flap 34, through which the length of the conductive strap 40 between the buckles 20 and 30 may be adjusted, and through which the conductive strap 40 is retained in the buckle 30. The conductive strap 40 is preferably fabricated of an elastic material, having a resistance in the range from 106 to 108 ohms. Conductive straps 40 having such resistance will not expose the wearer to severe and painful electrical shocks from inadvertent contact with high potential current sources, while still efficiently draining electrostatic charges. The conductive strap 40 is of a texture and thickness to provide abrasion resistance and tear strength to withstand continued contact and sliding over the conductive flooring. The conductive strap 40 may further includes a plurality of flush-head metal rivets (not shown) in that portion of the conductive strap 40 underlying the heel of the wearer's shoe, to counteract soil buildup on the conductive strap 40 which acts as an insulator.

The assembly, operation and use of the heel grounder 10 of the preferred embodiment of the present invention may also be described. Initially a section of the conductive strap 40 approximately 18 inches long is cut to length. One end of that conductive strap 40 is inserted and locked into place in the first buckle 20, while the other end of the conductive strap 40 is inserted and pulled through the second buckle 30 having the flap 34. The first hook member or clip 22 is attached to the upper portion of the wearer's shoe, preferably just below the wearer's ankle (see FIG. 3). The conductive strap 40 is pulled around the heel portion of the shoe. The second hook member or clip 32 is similarly placed over the upper portion of the wearer's shoe. The conductive strap 40 is pulled through the second buckle 30 and moderately stretched until it is held in tension against the heel, after which the locking flap 34 is closed. The loose end of the conductive strap 40 is then tucked inside the wearer's sock so as to touch his or her skin.

The heel grounder 10 fits well on nearly any conventional shoe, regardless of style or size. The conductive strap 40 is replaceable upon collecting up debris or wearing thin, or for subsequent use by different individuals. The wearer when standing or walking on a grounded conductive surface is himself or herself effectively grounded to zero electrical potential. Electrical components to be assembled are also maintained at zero potential, thus there is no static discharge to the component to cause damage.

It is understood that the improved heel grounding device 10 described herein and shown in the drawings represents only a presently preferred embodiment of the invention. Indeed, various modifications and additions may be made to this embodiment without departing from the spirit and scope of the invention. These and other modifications and additions may be obvious to those skilled in the art and may be implemented to adapt the present invention for use in a variety of different applications.

What is claimed is:

1. A grounding device adaptable to be worn around the heel portion of the wearer's shoe, said grounding device comprising:

a first and a second buckle, said buckles each having a hook member attaching the buckle to the upper portion of the wearer's shoe; and a conductive strap extending from the first buckle around the heel portion of the wearer's shoe to the second buckle, said conductive strap further extending to be in electrical contact with the wearer's leg;

whereby electrostatic voltages are dissipated from the wearer to ground.

2. The grounding device of claim 1, wherein the second buckle has adjustment means, such that the length of the conductive strap between the two buckles may vary.

3. The grounding device of claim 2, wherein the second buckle adjustment means are a locking flap to retain the conductive strap.

4. The grounding device of claim 1, wherein the conductive strap is an elastic material.

5. The grounding device of claim 1, wherein the conductive strap provides a continuous ohmic path having a resistance in the range of from 106 to 108 ohms.

* * * * *